US005450911A

United States Patent [19]

Gustafsson

[11] Patent Number: 5,450,911

[45] Date of Patent: Sep. 19, 1995

[54] SAFETY ARRANGEMENT FOR DRIVING TOOLS

[75] Inventor: Lennart K. R. Gustafsson, Kalmar, Sweden

[73] Assignee: Atlas Copco Berema Aktiebolag, Nacka, Sweden

[21] Appl. No.: 165,066

[22] Filed: Dec. 10, 1993

Related U.S. Application Data

[63] Continuation of Ser. No. 899,799, Jun. 17, 1992, abandoned.

[30] Foreign Application Priority Data

Jun. 24, 1991 [SE] Sweden ..... 9101930

[51] Int. Cl.[6] ..... B25D 9/04; B25D 17/10; B25D 17/11

[52] U.S. Cl. ..... 173/13; 173/211; 173/DIG. 2; 227/147; 279/19.1

[58] Field of Search ..... 173/211, 130, 131, 132, 173/133, 128, 129, 210, DIG. 2, 13; 279/19, 19.1, 19.2, 77; 227/147

[56] References Cited

U.S. PATENT DOCUMENTS

| | | | |
|---|---|---|---|
| 1,142,238 | 6/1915 | Cook | 173/211 |
| 1,464,570 | 8/1923 | Hage | 173/132 X |
| 1,497,476 | 6/1924 | Binnie | 173/211 X |
| 1,642,490 | 9/1927 | Decker | 173/13 X |
| 3,559,753 | 2/1971 | Meri | 173/DIG. 2 |
| 4,470,440 | 9/1984 | Thor | 173/211 X |
| 4,585,077 | 4/1986 | Bergler | 173/13 X |
| 4,648,609 | 3/1987 | Deike | 173/131 X |

FOREIGN PATENT DOCUMENTS

| | | | |
|---|---|---|---|
| 0085032 | 5/1984 | Japan | 173/131 |

*Primary Examiner*—Richard K. Seidel
*Assistant Examiner*—Clark F. Dexter
*Attorney, Agent, or Firm*—Mark P. Stone

[57] ABSTRACT

A railroad spike driving tool (30) is adapted to be inserted by its shank (22') for cooperation into hand-held hammer machines of the type comprising a machine housing (10) with a cylinder (11), in which a reciprocating drive piston (14) via a gas cushion in a working chamber (12) repeatedly drives a hammer piston (15) to impact on the shank (22') during spike driving. Forward sudden displacement of the shank (22') causes the hammer piston (15) to perform a forward blow in the void and come to rest. If the tool (30), as a result of the last impact and simultaneous sideward shifting of the machine, happens to hit against the rail, a safety spring (36), pre-stressed between a rearwardly facing shoulder (34) on the tool (30) and the machine housing (10), prevents the tool (30) from bouncing back into the machine and thus from being hit by said hammer blow in the void or from releasing a new blow. Possible injury to the operator is thereby avoided.

9 Claims, 3 Drawing Sheets

SAFETY ARRANGEMENT FOR DRIVING TOOLS

This application is a continuation, of application Ser. No. 07/899,799, filed Jun. 17, 1992, now abandoned.

BACKGROUND OF THE INVENTION

The invention relates to driving tools to be used with percussive hand-held machines primarily of the type incorporating a machine housing with a cylinder therein and having holding means thereon for supporting the tool in front of said cylinder axially movably between an inner and an outer position thereof, and in which cylinder a reciprocating drive piston via a gas cushion repeatedly drives a hammer piston forward to impact on and to move back away from the tool disposed in the inner position thereof, whereas the hammer piston is adapted to perform an idle blow and come to halt when the tool is disposed in said outer position thereof.

In the above type of machines, inter alia in connection with their use in railroad spike driving, there can under unhappy circumstances occur foot injuries the instant the machine is brought to rest. If the operator namely happens to lift the machine so that the tool, in response to the last blow delivered by the machine, is caused to bounce against the rail or other workpiece or against the arresting lever for the tool, the tool will spring back into the machine and can be hit by a next undamped blow or start a new hammer blow, whereby injuries are risked or at least the arresting lever is subjected to undesirable load.

Spring loaded spike guiding sleeves have been previously used on tools for driving railroad spikes as seen from for example patent specifications U.S. Pat. No. 1,808,452 and U.S. Pat. No. 2,325,728. These relate, however, to compressor dependent machines of unrelated type and are constructionally unsuited to solve the problems met by the present invention. The same applies to the nail guiding sleeve and spring shown in patent specification U.S. Pat. No. 2,671,216.

SUMMARY OF THE INVENTION

It is an object of the invention to assure, primarily in connection with the type of hammer machines mentioned in the opening paragraph above and particularly in powerful modern such machines, that the driving tool after the last working blow will not be subjected to further unintended hard blows that would endanger the operator and cause injury to him or damage to the machine.

BRIEF DESCRIPTION OF THE DRAWINGS

The invention is described in more detail with reference to the accompanying drawings. Therein

DESCRIPTION OF THE BEST MODES OF CARRYING OUT THE INVENTION

Figure 1:
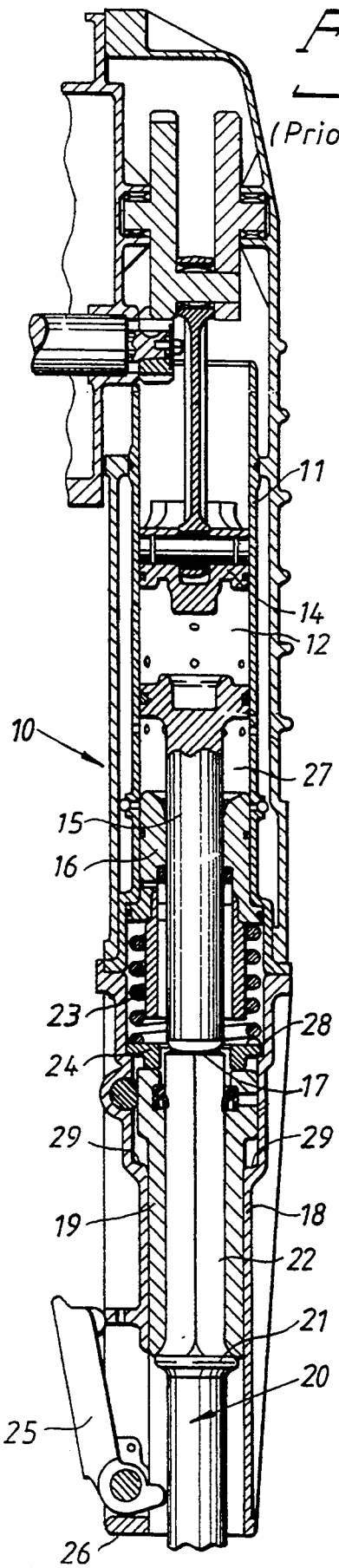
Fig. 1 (Prior Art)
FIG. 1 shows a partial longitudinal section through a hand-held machine of conventional type suitable for use together with the invention.
Figure 3:
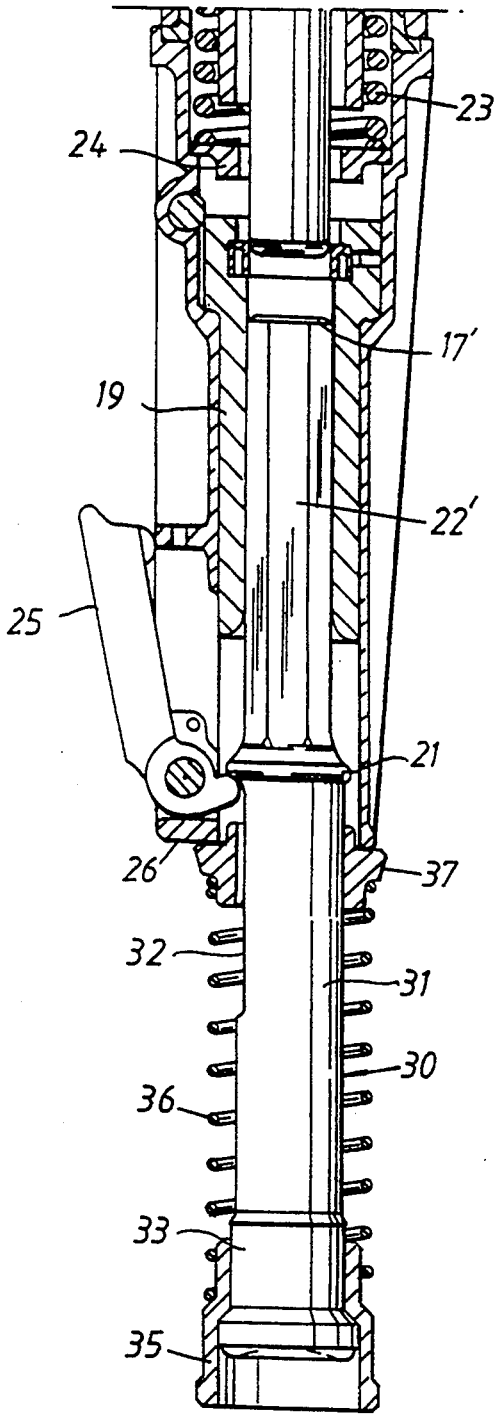
FIG. 3 illustrates the machine together with a unitary driving tool in its idle or inactive position.

The hammer machine in FIG. 1 comprises a hand held machine housing 10 with a cylinder 11, in which a differential hammer piston 15 is slidably guided and sealed. The hammer piston 15 delivers impacts against the neck 17 and shank 22 of a tool 20, such as a chisel, tamper or drill, which by a collar 21 is applied axially against a tool sleeve 19 and is slidably and, when desired, non-rotatably guided therein. The tool sleeve 19 in its turn is axially slidably guided in the front end 18 of housing 10. In the working position shown in FIG. 1 the sleeve 19 abuts against a spacing ring 24. A recoil spring 23 is prestressed between the bottom portion 16 of the cylinder 11 and the spacing ring 24, urging the latter onto an inner shoulder 28 in the front end 18. The precompression of spring 23 is such as to balance the weight of the machine when the latter is kept standing on the tool 20 in the position shown. When the machine is lifted, the tool sleeve 19 will sink down to an inactive position against an abutment shoulder 29 in the front end 18, while the sinking movement of the tool 20 continues and is stopped by the collar 21 being arrested by a stop lever 25. FIG. 3 of the drawing illustrates the machine together with the unitary driving tool in the idle or inactive position. Simultaneously therewith the hammer piston 15 sinks down forward taking an inactive position in a braking or damping chamber 27 in the foremost part of the cylinder 11.

Figure 4:
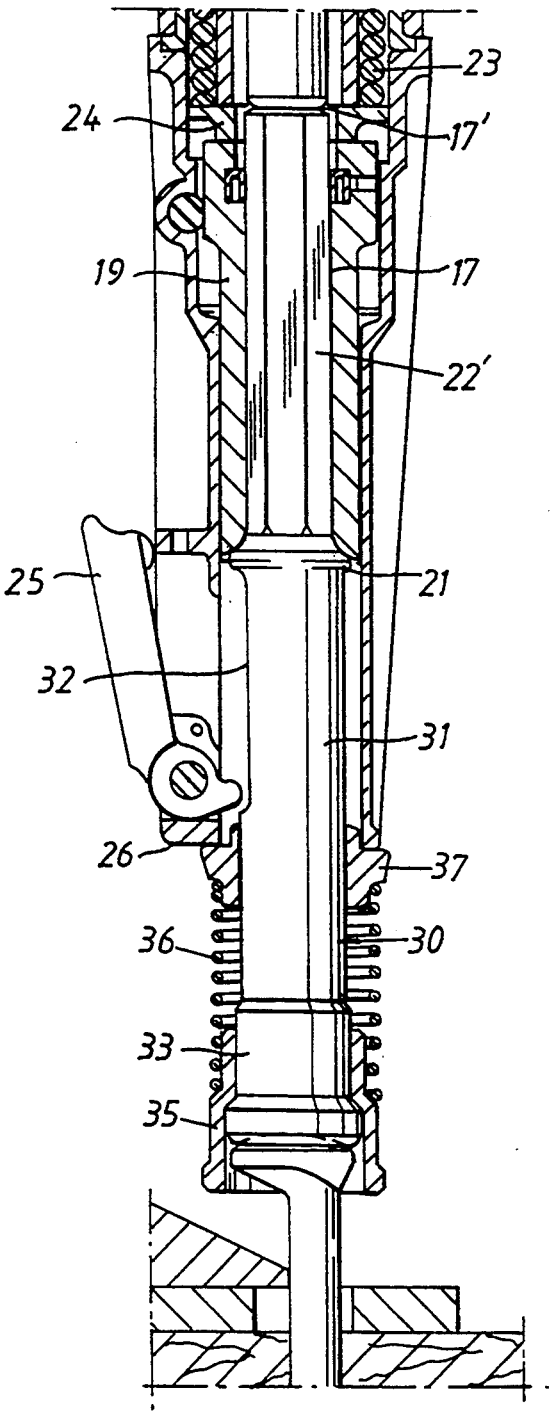
FIG. 4 illustrates the machine together with the unitary driving tool, as illustrated in FIG. 3, in which the machine is in its working or active position with the tool pressed against a spike.

At work, with reference to FIG. 1, a drive piston 14 performs a reciprocating movement in the cylinder 11 driven via a crank mechanism by a motor, not shown, built-in in the machine housing 10. Via a gas cushion in the working chamber 12 of the cylinder 11 the hammer piston 15 is repeatedly driven to impact against the neck 17 of the shank 22. At non-impacting idle blows, in response to the tool 20 taking an outer position by having been displaced downward-forward from its inner position shown in FIG. 1, the hammer piston 15 is caught and pneumatically arrested in the braking chamber 27. Inward-backward movement of the tool 20 brings the hammer piston 15 back to its position in FIG. 1, but the piston 15 remains at rest and non-operative since a rebound from neck 17 is needed to maintain repetitive impacting reciprocation. The operator must first force the hammer piston 15 deeper up into the cylinder 11 by feeding the machine housing 10 forward, compressing recoil spring 23 and causing the reciprocating drive piston 14 to suck up the hammer piston 15 in order to generate a first blow and then continued reciprocation. A detailed description of the build-up and function of the machine shown can be had from patent specification U.S. Pat. No. 5,052,498. FIG. 4 illustrates the machine together with the unitary driving tool in its active or operating position in which the recoil spring 23 is shown in its fully compressed position and in which the machine is in its working position with the tool pressed against a spike.

Figure 2:
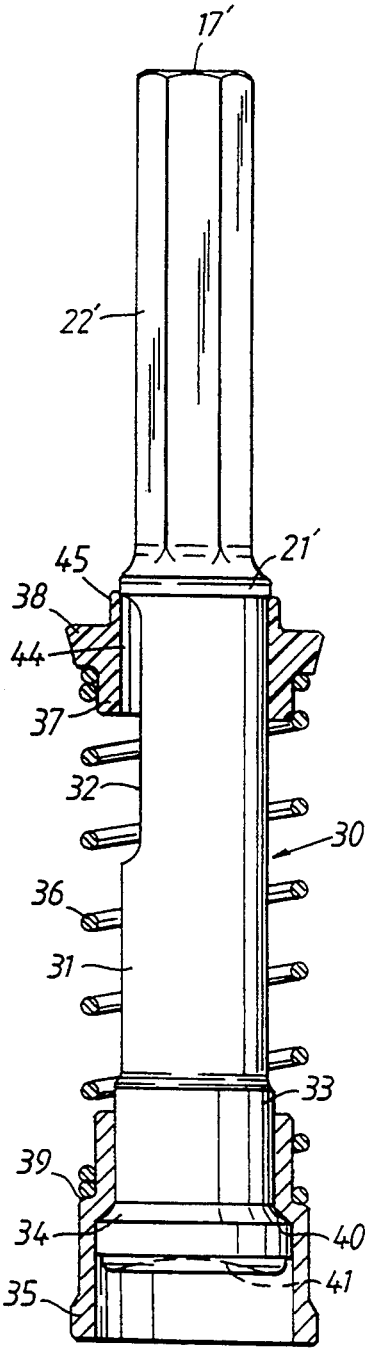
FIG. 2 shows a spike driving tool according to the invention and for use with the machine in FIG. 1 or some other suitable machine of similar type.

When the hammer piston 15 of the machine is to be caught in the braking chamber 27 due to the tool sinking forward-downward, there occurs in certain types of tools, for example conventional driving tools for railroad spikes, the risk for foot injuries as mentioned above in connection with the background of the invention. FIG. 2 shows how such risk can be eliminated. The driving tool 30 with the shank 22' and collar 21' has a shaft 31 with a reduced portion 32 for locking cooperation with the tool stop lever 25 of the machine housing 10 and a thickened cylindrical front end 33 with an inturned face 41 for cooperation with the spike, not shown, during driving. The front end 33 incorporates a rearwardly directed first shoulder 34, against which a guiding sleeve 35 of steel abuts by an inner shoulder 40 and is slidable on and around the front end 33. Slidably on the rear of shaft 31 is seated a buffer sleeve 37 made of plastic material, preferably of polyurethane, for purposes of providing sound dampening under impact load, and which has a split 44 for being opened elastically and bent over to ride on shaft 31. A safety spring 36 is disposed around the driving tool 30 between a radially protruding flange 38 on the buffer sleeve 37 and and an outer shoulder 39 on the guiding sleeve 35. The safety spring is pre-stressed between the first shoulder 34 and a second shoulder, i.e. front facing shoulder of collar 21', with the guide sleeve 35 interposed between spring 36 and the first shoulder 34 and the buffer sleeve 37 between spring 36 and the front facing shoulder of collar or 21'.

The driving tool 30 is inserted by shank 22' to replace the tool 20 in FIG. 1 in the machine housing 10. That brings the buffer sleeve 37 to be pressed by safety spring 36 against the machine front end 26 further stressing safety spring 36 and biassing the driving tool in forward direction via guiding sleeve 35 and the first shoulder 34. The stop lever 25, by cooperation with the reduced portion 32 and collar 21' of shaft 31, maintains the tool 30 in a forward idle position in the machine housing 10 unless operation is started by feeding the machine forward and moving the tool 30 and its shank 22' to their inner position (See FIG. 3 which illustrates the machine together with the unitary driving tool in its idle or inactive position).

It is evident in operation that, when the operator wants to lift and and move the machine 10 sideward, the force of safety spring 36 will prevent the tool 30 from bouncing back toward the inner working position of shank 22'. Neither can the driving tool 30 fall back to said working position by its weight when the machine is laid down on uneven ground with the motor on. The safety spring 36 is not subjected to direct impact and possible rattling is damped out by the plastic material of buffer sleeve 37, which offers a certain additional protection of the machine front end 26. In a conventional way the guide sleeve 35 prevents the tool 30 from sliding off the spike and yields back against the force of safety spring 36 at the end of the driving operation without scratching the rail or the spike plate.

The safety arrangement according to the invention is applicable also for spike driving operations of other type, for example for nailing down traffic knobs and clamping bars, and for use in machines of similar type with tools such as chisels, tamping tools and breaking bars in general, always where the risk for injuries might be present. In such applications, particularly on long tool shafts, the safety spring 36 can have its first rearwardly facing abutment shoulder on an intermediate collar suitably and sufficiently spaced from the front end of the standard tool collar so that the safety spring 36 will be able to press the buffer sleeve 37 against the front end 26 of the machine when the tool has been mounted therein. A sleeve extension 45, FIG. 2, adapted to penetrate into the front end 26, may be provided on the buffer sleeve 37 in order to keep said sleeve centered in front of the machine housing 10. The guiding sleeve can be omitted if not needed for the work at hand.

I claim:

1. A unitary driving tool assembly in combination with a percussive handheld machine, said machine being of the type incorporating a machine housing with a cylinder therein, a front end of said housing having releasable holding means interiorly therein for supporting a driving tool in front of said cylinder, said driving tool being longitudinally movable between a retracted and an extended position, a reciprocating drive piston in said cylinder which, via a gas cushion, repeatedly drives a hammer piston forward to impact on and to move back away from the tool in the retracted position thereof, a braking chamber defined in said housing in a front portion of said cylinder, said hammer piston performing an idle blow and coming to halt in said braking chamber when the tool is in said extended position, said unitary driving tool assembly for improving the safety of said machine in operation comprising said driving tool, said driving tool having a shank on a rearward end thereof, said shank slidably received by said holding means in said machine housing for supporting said tool and cooperating with said piston, a rearwardly facing first shoulder on said tool distal to and in front of said shank, a shaft on said tool between said shank and said first shoulder extending frontwardly beyond said front end of said machine housing when said shank is received in said holding means of said machine housing, said unitary driving tool assembly further comprising a buffer sleeve slidably mounted on and carried by said shaft in front of said shank, and a spring around said shaft supported between said first shoulder and said buffer sleeve and urging said buffer sleeve towards said shank when said tool is released from said holding means, said spring pressing said buffer sleeve from the outside of said machine housing against said front end of said machine housing when said shank is received by said holding means for constantly urging the tool towards said extended position and counteracting undesirable tool rebound to said retracted position from said braking chamber subsequent to unintended bouncing of said tool against outer obstacles in response to an idle blow.

2. The combination according to claim 1, wherein said unitary driving tool assembly further comprises a work guiding sleeve interposed between said spring and said first shoulder slideably on said tool.

3. The combination according to claim 1, wherein said buffer sleeve is made of plastic material having sound damping properties.

4. The combination according to claim 1, wherein a collar is provided on said tool in front of said shank, a frontwardly facing second shoulder is provided on said collar, and said buffer sleeve is provided in front of said second shoulder for pressing against said second shoulder when said tool is removed from said machine housing to form said unitary assembly together with said buffer sleeve and said spring.

5. The combination according to claim 1, wherein said buffer sleeve is split to enable the buffer sleeve to be bent open elastically at said split and movable along said shaft.

6. The combination according to claim 1, wherein a rearward sleeve extension is provided on said buffer sleeve for centering penetration into the front end of said hammer machine when said shank is mounted thereinto.

7. The combination according to claim 1, wherein a forward sleeve extension is provided on said buffer sleeve supporting the rearward end of said spring in spaced relation around said shaft.

8. A driving tool unit comprising a driving tool having a shank at a rearward end thereof, a collar adjacent said shank for arresting longitudinal movement of said shank after said shank has slid a predetermined distance relative to and within a hammer machine with said shank in percussive cooperation with said hammer machine, a shaft on said tool protruding forwardly from said collar beyond a front end of said hammer machine when said shank is mounted therein, a rearwardly facing first shoulder at a frontward end of said shaft distal to said shank, a frontwardly facing second shoulder on said collar, said tool unit further comprising a buffer sleeve made of sound dampening plastic material slidably mounted on said shaft, a spring around said shaft supported between said first shoulder and said buffer sleeve and urging said buffer sleeve towards said second shoulder, said tool unit forming an independent single piece tool unit assembly in which said spring and buffer sleeve are mounted to the shaft such that said buffer sleeve is not removed from said shaft when the driving tool is removed from said hammer machine, said spring and said buffer sleeve being mounted such that they are arrested with respect to movement along said shaft between said first and second shoulders, said buffer sleeve of said tool unit being retractable on said shaft into a spaced relationship relative to said second shoulder to compress said spring, and said buffer sleeve abutting against the front end of said hammer machine to compress said spring in response to said shank and collar of said tool being slid said predetermined distance relative to and within said hammer machine so that said shank is in percussive cooperation with said hammer machine, said hammer machine comprising laterally movable arresting means engageable with said tool unit for arresting a sliding movement of said shank relative to said hammer machine at a predetermined position of said shank relative to said hammer machine such that retraction of said buffer sleeve uncovers a portion of said shaft in front of and adjacent to said second shoulder for sliding engagement with said lateral arresting means of said hammer machine, said shaft having a reduced axially extending portion adjacent to and in front of said second shoulder for sliding engagement with said lateral arresting means of said hammer machine.

9. An independent driving tool assembly comprising a driving tool having a shank at a rearward end thereof for slideable mounting in and percussive cooperation with a hammer machine via an impact receiving rear face of said shank; a rearwardly facing first shoulder at a frontward end of said tool distal to said shank, a frontwardly facing second shoulder on said tool in front of said shank, a shaft on said tool between said first and second shoulders, said shaft being of a length for extending frontwardly beyond said hammer machine when said shank is mounted therein, said independent driving tool assembly further comprising a buffer sleeve made of sound dampening plastic material slidably mounted on and fixedly carried by said shaft between said first and second shoulders, a spring around said shaft supported between said first shoulder and said buffer sleeve and urging said buffer sleeve towards said second shoulder such that said buffer sleeve is urged against said second shoulder when said tool is removed from said hammer machine, said buffer sleeve being forceably pressed by said spring against the front end of said hammer machine when said shank is mounted into said machine, said buffer sleeve including a forward sleeve extension for supporting the rearward end of said spring in spaced relation around said shaft, said hammer machine comprising laterally movable arresting means engageable with said tool unit for arresting slideable movement of said shank relative to said hammer machine at a predetermined position of said shank relative to said hammer machine such that retraction of said buffer sleeve uncovers a portion of said shaft in front of and adjacent to said second shoulder for sliding engagement with said lateral arresting means of said hammer machine, said shaft having a reduced axially extending portion adjacent to and in front of said second shoulder for sliding engagement with said lateral arresting means of said hammer machine.

* * * * *